United States Patent [19]

Beck et al.

[11] 4,007,984

[45] Feb. 15, 1977

[54] METHOD AND APPARATUS FOR HANDLING A BELT OF PHOTOCONDUCTIVE MATERIAL

[75] Inventors: Christian A. Beck, Ridgefield; David W. Hubbard, Stamford, both of Conn.

[73] Assignee: Pitney-Bowes, Inc., Stamford, Conn.

[22] Filed: Sept. 4, 1975

[21] Appl. No.: 610,295

Related U.S. Application Data

[63] Continuation of Ser. No. 384,938, Aug. 2, 1974, abandoned.

[52] U.S. Cl. ..... 355/16; 226/118

[51] Int. Cl.[2] ..... G03G 15/00

[58] Field of Search ..... 355/16; 226/118, 119; 270/61 F

[56] References Cited

UNITED STATES PATENTS

| | | | |
|---|---|---|---|
| 2,865,639 | 12/1958 | Gillette et al. | 226/118 X |
| 2,986,442 | 5/1961 | Broding | 355/16 X |
| 3,123,269 | 3/1964 | Morley et al. | 270/61 F |
| 3,155,022 | 11/1964 | Schwertz | 355/16 X |
| 3,281,042 | 10/1966 | Hardison et al. | 226/118 |
| 3,311,279 | 3/1967 | Yeiser | 226/118 |
| 3,556,374 | 1/1971 | Demke | 226/119 |
| 3,672,795 | 6/1972 | Altmann | 355/16 X |
| 3,756,488 | 9/1973 | van Megen et al. | 355/16 X |
| 3,926,625 | 12/1975 | van der Sterren | 355/16 X |

*Primary Examiner*—Richard L. Moses
*Attorney, Agent, or Firm*—Martin D. Wittstein; William D. Soltow, Jr.; Albert W. Scribner

[57] ABSTRACT

A method and device for handling an endless, flexible, articulated belt of photoconductive material. The belt is continuously moving, and a housing is provided to store the greater portion of the belt which is not being run through copier machinery. A pair of feed rollers feeds a quantity of belt material returning from the copier machine to the housing, and a pair of dispensing rollers are synchronized with the feed rollers so as to eject a like quantity of belt material to the copier. Therefore, although the portion of the belt within the housing is continuously changing, the unit mass of material within the housing remains substantially constant. The photoconductive belt is uniquely fan-folded within the housing to provide a compact bundle of material, and the bundle is made to reciprocally translate within the housing, as the belt is fed to, and dispensed from, the housing. The dispensed photoconductor generally undergoes an imaging process comprising the steps such as: (a) charging; (b) exposing; (c) developing; (d) transferring; and (e) cleaning; etc.

11 Claims, 4 Drawing Figures

FIG. 3
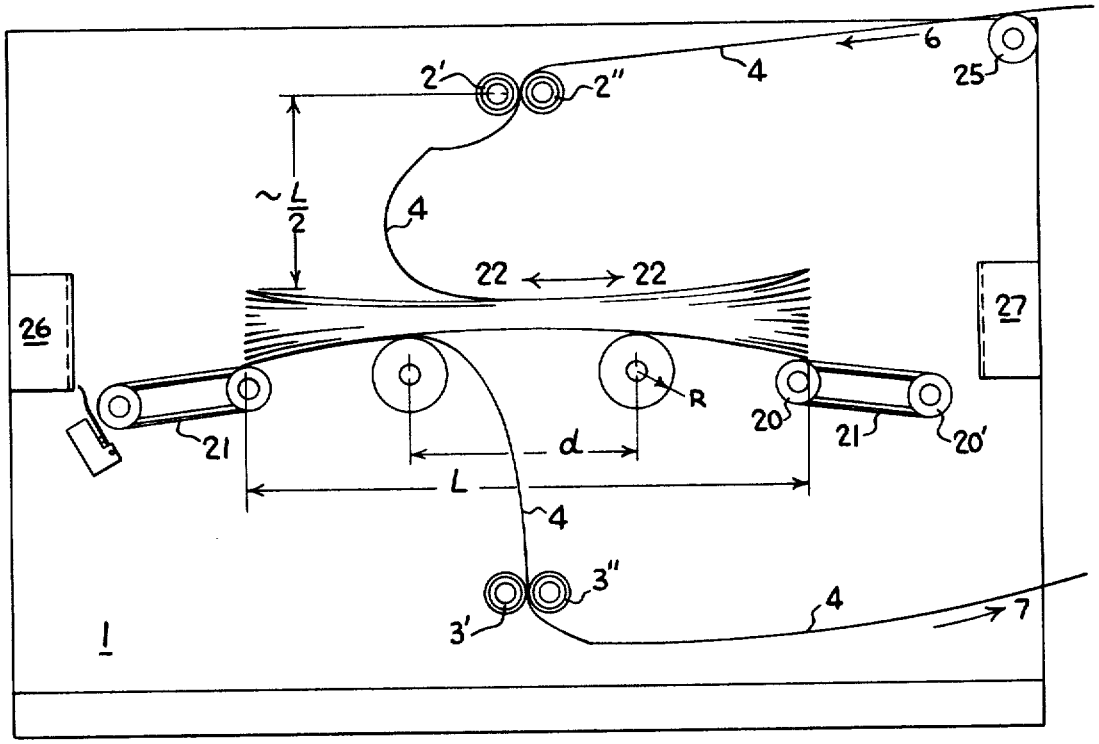
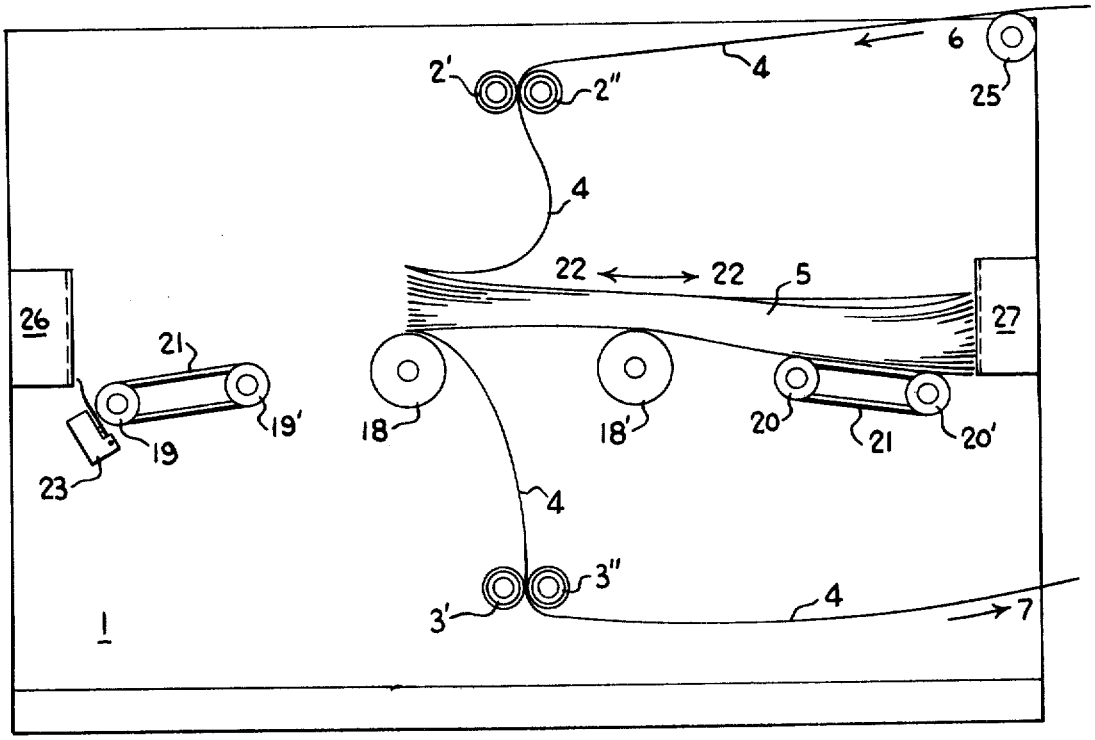
FIG. 2

METHOD AND APPARATUS FOR HANDLING A BELT OF PHOTOCONDUCTIVE MATERIAL

This is a continuation of application Ser. No. 384,938 filed Aug. 2, 1974 now abandoned.

The invention pertains to photoconductive materials and a method and a device for handling them, and more particularly to a method and apparatus for feeding, storing, and dispensing a quantity of flexible, articulated, photoconductive web-like material through a copier system.

The present invention concerns a moving endless belt, whose greater portion is kept stored within a housing, while a smaller portion is run through copier machinery. The subject invention is for particular use in conjunction with a belt of photoconductive material such as zinc oxide, which is being run through a xerographic copier system. The flexible, articulated, photoconductive belt for use in this invention is uniquely fan-folded within its housing, and has discrete sections which are joined at their edges to form an endless web of material. A given amount of the photoconductor is dispensed from the housing in sectioned quantities, and each section undergoes an imaging process generally comprising the steps such as: (a) charging; (b) exposing; (c) developing; (d) transferring; and (e) cleaning; etc. After the transferring and cleaning steps, the photoconductor is returned to the housing.

BACKGROUND OF THE INVENTION

Heretofore, one of the basic problems with certain types of photoconductive materials such as a zinc oxide belt, was that after sections of the belt were exposed to light to form an image thereon, the material would require a certain amount of time in darkness to recover its photoconductive properties. This phenomenon is generally known in the art as allowing the photoconductor to "dark adapt". The relative time required for this recovery is comparatively long with respect to the speed of the copier system. Therefore, it is necessary to have a long expanse of photoconductive material (many sections), which is cycled through the system. Thus, segmented amounts of the web are serially charged exposed, toned, cleaned, and then serially returned as spent material to a storage area for recovery purposes. While the spent material is allowed to "dark adapt", fresh image receiving segments of photoconductive material are supplied to the copier system to make subsequent copies of original documents. Each segment receives a full document image, and may be made equal to or slightly larger than the document size.

In copier systems demanding frequent use, the stored quantity usually has a large volume. The present invention is for a method of use of a uniquely folded photoconductor and a compact system for storing and dispensing large amounts of this photoconductor.

SUMMARY OF THE INVENTION

The invention uses a flexible, segmented, fan-folded photoconductive web of material, and comprises a method and compact device for all allowing the storage and dispensing of a large amount of this photoconductive material through a copier system.

The invention has as one of its novel features, the capability of moving the stored portion of the web as a substantially constant unit mass, while the stored material is continuously changing during operation, to provide ease of dispensing.

Another novel feature of the invention is that the web is stored fan-folded within its housing to provide compactness in storage. The web is folded flat with respect to its support.

Still another novel feature is provided by the reciprocatory translation of the stored mass of material, which motion cooperates with the feeding and dispensing rollers to produce reliable ingress and egress of the web.

This material handling device of the invention comprises means to support a portion of an endless web in compact fashion for storage purposes. Feeding and dispensing means are provided, such as two spaced apart pairs of stationarily positioned-synchronized rollers, for continuously changing the stored material. Because the feed rollers are synchronized with the dispensing rollers, the quantity of stored material remains substantially constant, despite the fact that new material is continuously entering and exiting from the stored mass. The mechanism of the device is such that means are provided to move the stored mass as a unit with respect to the support, or with respect to the feeding and/or dispensing rollers, in conjunction with movement of the material through the stored mass.

The method of the invention comprises dispensing or otherwise propelling, a flexible, photoconductive, segmented, sheet of material from one end of a large stack of fan-folded sections. The web of photoconductor is fed through a series of processing stations. One of the stations is a charging station. Another station is an imaging station, where successive individual segments of the photoconductor are exposed between their fold lines to form a latent image on the sections.

At other processing stations, the individually imaged segments of the photoconductor are developed, and then the developed image is transferred from the photoconductor to a sheet material, such as paper. The belt or web of photoconductor is then generally cleaned and subsequently returned to an opposite end of the stack. The returned photoconductive segments are deposited upon the stack and undergo a storage period to allow the photoconductor to "dark adapt".

It is an object of the invention to provide an improved photoconductive material handling device.

It is another object of this invention to provide a compact and reliable storage and feeding device for handling a quantity of web-like photoconductive material.

It is but another object of the invention to provide a reliable web storage and dispensing device for a unique fan-folded photoconductive web bundle.

It is still another object of this invention to provided an improved method of using a web of photoconductive material to produce copies of an original document.

It is yet another object of this invention to generally subject a photoconductive web of material to the processes of: (a) charging; (b) exposing; (c) developing; (d) transferring; and (e) cleaning; etc.

These and other objects of this invention will become more apparent, and will be better understood, with respect to the following detailed description and accompanying drawings, in which:

FIG. 2 is a frontal view of the inventive device of FIG. 1 with the exception that the web material bundle is shown in a second end position reciprocal to that of the first end position;

FIG. 3 is a frontal view of the inventive device of FIG. 1 with the web material bundle moving through an intermediary position between the first and second end positions.

DETAILED DESCRIPTION

Generally speaking, the invention uses a unique fan-folded photoconductor and comprises a material handling device for this web-like photoconductive material. The device comprises a material support for supporting a compactly arranged portion of an endless belt which defines a stored portion. Feed and dispensing means, such as a spaced apart rotating pair of rollers, feed a given quantity of the material towards the stored portion, and dispense a similar quantity from the stored portion. This results in there always being a substantially constant stored mass of material, despite the fact that the material is continuously changing within the stored mass. Means are also provided for moving the stored portion as a unit mass with respect to the supporting means and with respect to either or both of the feeding and dispensing means.

The invention is also for a method of using the aforementioned photoconductive web in a xerographic process, generally comprising the steps such as: (a) charging; (b) exposing; (c) developing; (d) transferring; and (e) cleaning; etc.

Figure 1:
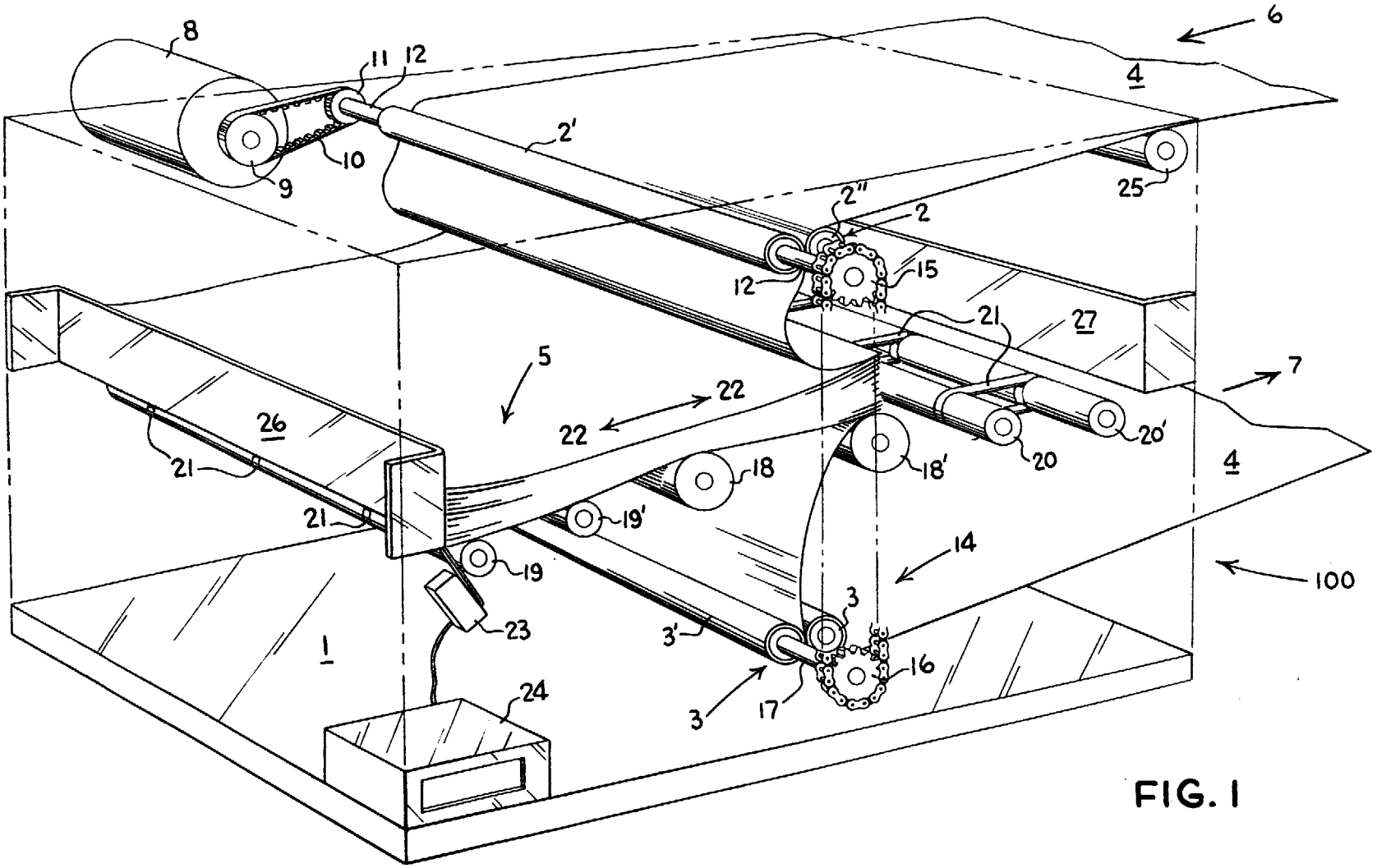
FIG. 1 is a perspective view of the inventive device with the web material bundle translated to a first end position.

Now referring to FIG. 1, a perspective view of the inventive device is shown. A housing or frame 1 is generally shown supporting two pairs of spaced apart rotating rollers 2 and 3, respectively. The pair of rollers 2 are in pressure contact with each other and have movably disposed between them a portion of the photoconductive web material 4. The pair of rollers 3 are likewise in pressure contact with each other, and similarly have movably disposed between them another portion of the web material 4. Between these pairs of rollers 2 and 3 is a stored bundle of a photoconductive fan-folded web of material shown by arrow 5. The rollers 2 act as feed rollers, which supply the stored bundle 5 with a continuously changing supply of web material. The pair of rollers act as dispensing rollers and continuously draw from said stored bundle 5 a new supply of web material 4. The ingress and egress of the web 4 from the housing 1 and the bundle 5, is depicted by arrows 6 and 7, respectively, and may be aided by supporting guide rollers, such as roller 25.

The rollers 2 are driven through a pulley system by a constant speed motor 8. The motor 8 powers pulley 9. A belt 10 is positioned over pulley 9 and a pulley 11, so that pulley 11 will be made to turn when pulley 9 is made to turn. Pulley 11 is connected to one of the rollers 2′ of roller pair 2 by shaft 12. Since the roller 2′ is made to rotate by motor 8, the other roller 2″ of the roller pair which is in pressure contact with the first roller 2′ will likewise rotate, causing the interdisposed web material 4 to be drawn into the housing 1.

The belt 10 is a timing belt, so that no slippage occurs between the pulleys 9 and 11, respectively.

The dispensing rollers 3 are powered by motor 8 through the aforementioned pulley system, and a chain-and-sprocket drive generally shown by arrow 14. Sprocket 15 is connected to shaft 12 as is the roller 2′. A timing chain picks up the rotation of shaft 12 and sprocket 15, and transmits it to sprocket 16 which is connected to roller 3′ of the roller pair 3 by means of shaft 17. Similar to the roller pair 2, the dispensing rollers 3 are in pressure contact, so that when roller 3′ rotates, its mating roller 3″ also rotates. Rollers 2 and 3, respectively, synchronously turn in the same direction, so that the web of material 4 leaving bundle 5, and interdisposed between rollers 3′ and 3″, is made to exit from the housing as shown.

Bundle 5 is supported within the housing 1 by three pairs of supporting rollers 18, 18′; 19, 19′; and 20, 20′ journalled in the housing. The bundle of web material 5 is made to reciprocally translate as shown by arrows 22 with respect to housing 1, and also with respect to either pair of stationarily supported feed rollers 2 and 3.

OPERATION OF THE DEVICE

The operation of the device will be explained with reference to FIGS. 1 through 3. Like operative elements of FIGS. 2 and 3 have the same designations as those of FIG. 1.

Photoconductive bundle 5 is fan-folded, and is supported as aforementioned by rollers 18, 18′; 19, 19′; and 20, 20′, which are journalled in the housing. The middle pair of rollers 18 and 18′ are rotatively supported by the housing, and are made to turn as the bundle 5 moves back and forth over them from one end of the housing to the other end. Guide positions 26 and 27, respectively, define the end positions of the bundle travel. The end rollers 19, 19′ and 20, 20′, respectively are also free to rotate so as to reduce friction of the bundle moving over them, but are primarily functional only as supporting members as the bundle approaches and attains the end positions. Each of the end rollers 19, 19′ and 20, 20′, respectively, have several belt members 21 stretched across them (see FIG. 1, right-hand side). These belts 21 are spaced periodically along the length of the rollers. The function of the belts is to prevent the bundle 5 from slipping between either of the supportive roller pairs as it moves toward the end of its translatory travel.

The illustrated device is considered merely as an exemplary embodiment of the invention for the purposes of explanation. Consequently, it is considered that roller pairs 19, 19′ and 20, 20′ may be replaced by flat frictionless surfaces or an equivalent pair of smooth supporting guide members.

The photoconductive fan-folded bundle 5 is made to reciprocally translate as a unit mass across the housing between end guides 26 and 27 as shown by arrows 22. It is important to maintain the proper clearance distance between guides 26 and 27, and the rollers 18 and 18′, respectively, so that when the bundle 5 has reached its end position, a new sheet can be easily withdrawn past roller 18 and 18′, as the case may be. If the end travel distance is too short, the end of the sheet will be pinched between the bundle and the roller making withdrawal of the sheet difficult, and if this end travel distance is too long, one end of the bundle will not be provided with support by roller 18 or 18′. The translatory motion is primarily the result of the tension provided upon the web by the dispensing rollers 3, which when pulling a single fan-fold from said stack (bundle 5) of fan-folded elements, causes the stack to shift upon the rollers 18 and 18′. It is to be realized, however, that the desired reciprocation and sheet separation is also dependent upon the radius "R" of the rollers 18 and 18', the distance "*d*" between the centers of the rollers 18 and 18', and the thickness of the photoconductive sheet (FIG. 3). It has been found that for a stack of approximately 50 sheets of a Mylar-backed photoconductor of approximately 5 mils thickness, having a length "L" of 10 inches, R is 0.75 inch and *d* is 4 inches. In otherwords, the Ratio of d/R is equal to 5.3. The ratio of d/R is influenced by the stiffness of the web material. The height from the top of the bundle to the feed rollers should be approximately equal of L/2, or half the bundle length. The length of the loop extending outwardly into the copier from the top and bottom of the bundle 5, should approximate an even multiple of the length "L" of the bundle in order to achieve proper folding of the stack.

It must be remembered, that for a large weighted quantity of stored material 5, the tension in the dispensing rollers 3 must be sufficient to overcome inertial and frictional effects to provide reciprocation. Also, the material itself must not be too weak to sustain the required tension without ripping or otherwise becoming damaged.

Figure 4:
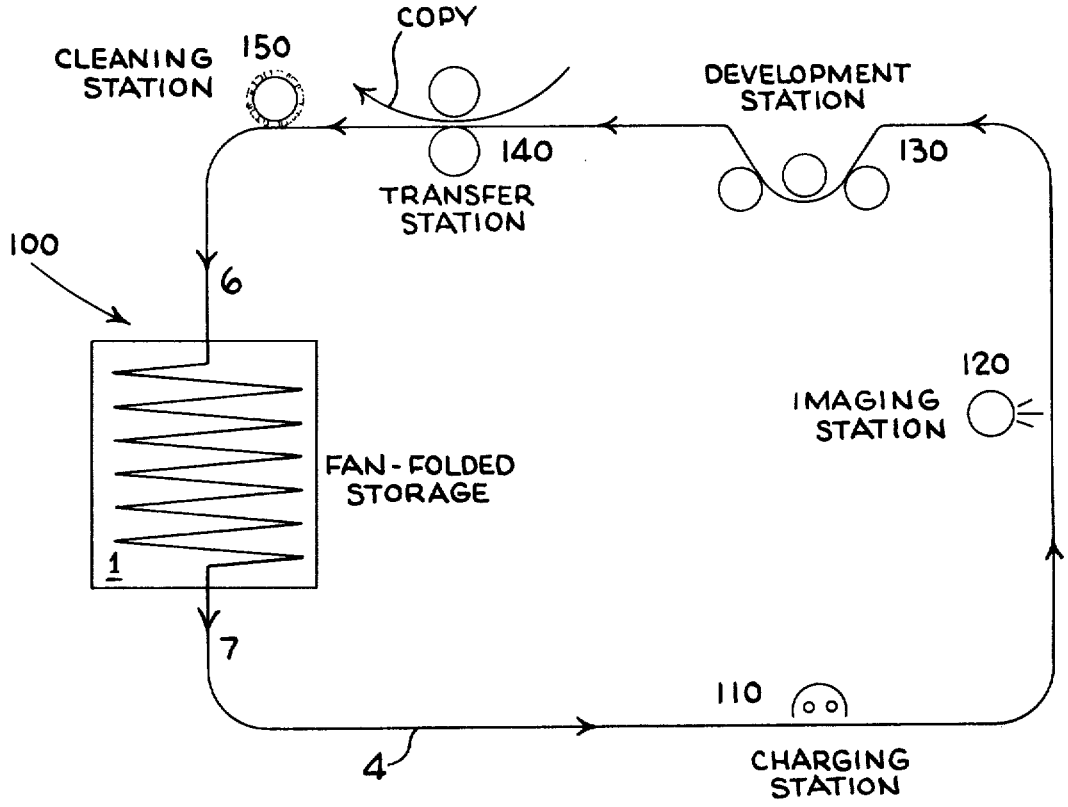
FIG. 4 is a schematic view of a copier system for the inventive device of FIG. 1.

Now with reference to FIG. 4, a schematic of a possible copier system is shown which can employ the photoconductor handling device of this invention.

The storage and dispensing mechanism of FIG. 1 is designated as station 100. Like designations as in FIG. 1 have been used to depict the belt, housing, and belt movement.

The belt 4 exits (arrow 7) the storage station 100 (housing 1), and continues on until it reaches a charging station 110. After being charged, the belt moves to an imaging station 120, where the original document is latently imaged upon the photoconductive web. The latent image is developed as the web travels through the developing station 130. Next, the developed image is transferred to a sheet of paper at transfer station 140. The photoconductor then continues onto a cleaning station 150, where remaining toner is removed. Finally, the used photoconductive material is reintroduced (arrow 6) into the storage area 100 in order to dark adapt.

The device of FIG. 1 may be provided with a register 24 to record the number of cycles of the bundle 5. A limit switch 23 disposed at one end position of the translatory travel of the bundle 5 can be used to trigger the register 24.

As regards copier systems, the present invention can be used with all kinds of photoconductive materials capable of being made into, or forming part of a web.

The illustrations disclosed herein are deemed to be exemplary, and only for the purpose of explanation. The full spirit and scope of the invention should be construed with respect to the appended claims, irrespective of any obvious modifications which can be made by those skilled in the art.

What is claimed:

1. A process of electrophotography using a closed looped belt supporting photoconductive material and arranged in sheet-like sections which are serially and articulatively interconnected, said sections being movable between a fan-folded condition and an unfolded condition, said process comprising the steps of:

a. successively moving the sheet-like sections of said belt from a fan-folded condition to an unfolded condition;

b. moving the unfolded sections of said belt through a series of processing stations;

c. moving the unfolded sections of said belt that have been moved through said processing stations from the unfolded condition to the fan-folded condition;

d. storing said fan-folded sheet-like sections of belt that have been moved through said processing stations for a period of time in said fan-folded condition before being moved to a successive unfolded condition; and e. reciprocally moving said fan-folded sheet-like sections back and forth in a translatory manner as a unit mass to facilitate moving said sheet-like sections of said belt between the fan-folded and the unfolded conditions.

2. The process as claimed in claim 1, wherein the step of moving the unfolded sections of said belt that have been moved through said processing stations from the unfolded condition to the fan-folded condition comprises fan-folding said sections of belt in a substantially flat fan-folded manner.

3. A device for handling a quantity of fan-folded photoconductive web material comprising:

A. means for supporting fan-folded photoconductive web material, said material comprising an endless web at least a portion of which is compactly arranged with respect to said supporting means to constitute a stored mass of said fan-folded material, B. edge abutment means operatively associated with and disposed on either side of said supporting means and having portions spaced apart a distance substantially greater than the length of said stored mass of material to define a limited path of travel of said stored mass of material relative to said supporting means, C. said supporting means further including surface portions disposed intermediate said abutment means and having portions spaced apart a distance substantially less than the length of said stored mass of material such that when an edge of said stored mass of material is in contact with one portion of said abutment means, the opposite edge of said stored mass is immediately adjacent the spaced apart portion of said support means;

D. feed means operatively associated with said endless web of material for simultaneously feeding said endless web of material to said stored mass of fan-folded material and dispensing said endless web of material from said stored mass of fan-folded material whereby the quantity of material in said stored mass remains substantially constant while the fan-folded material in said stored mass is continuously changing, said feeding means being thereby operative to cause reciprocal movement of said fan-folded stored mass of material between said edge abutment means along said limited path of travel, and E. means operatively associated with a portion of said web of material which is not disposed within said stored mass of fan-folded material for defining a path of travel of said latter portion of material from said supporting means exteriorily of said supporting means to said feeding means whereby when said feeding means is operative to feed said material, the portion of material being dispensed exerts sufficient pull on the stored mass of material on said supporting means to cause said stored mass of material to move back and forth along said path of travel defined by said abutment means.

4. A device for handling a quantity of fan-folded photoconductive web material comprising:

means for supporting fan-folded photoconductive web material, said material comprising an endless web at least a portion of which is compactly arranged with respect to said supporting means to constitute a stored mass of said fan-folded material;

edge abutment means disposed on either side of said supporting means and being spaced apart a distance substantially greater than a length of said material thereby defining a limited path of travel of said stored mass of material relative to said supporting means; and feed means operatively associated with said endless web of material for simultaneously feeding said endless web of material to said stored mass of fan-folded material and dispensing said endless web of material from said stored mass of fan-folded material whereby the amount of material in said stored mass remains substantially constant while the fan-folded material in said stored mass is continuously changing.

5. The device for handling a quantity of fan-folded photoconductive web material of claim 4 wherein said support means comprises a first, second, and third pair of rotating fixed position rollers.

6. The device for handling a quantity of fan-folded photoconductive web material of claim 5 wherein said first and third pairs of rotating fixed position rollers are located adjacent to and in between said edge abutment means.

7. The device for handling a quantity of fan-folded photoconductive web material of claim 6 wherein said first and third pairs of rotating fixed position rollers have belt means spaced along said rollers to further support said material.

8. The device for handling a quantity of fan-folded photoconductive web material of claim 7 wherein said second pair of rotating fixed position rollers are spaced apart a distance substantially less than said length of said material such that when an edge of said material is in contact with one of said abutment means, the opposite edge of said material is immediately adjacent said spaced apart portion.

9. The device for handling a quantity of fan-folded photoconductive web material of claim 4 wherein said feed means moves said material in a reciprocatory translation path.

10. The device for handling a quantity of fan-folded photoconductive web material of claim 9 wherein said material further defines a stored mass of flat fan-folded sheet material supported upon said support means.

11. The device for handling a quantity of fan-folded photoconductive web material of claim 10 further comprising guide means for guiding successive sheet sections in an unfolded condition along a path through processing stations of charging, imaging, development, transfer, and cleaning.

* * * * *